US009115451B2

(12) United States Patent
Konzak et al.

(10) Patent No.: US 9,115,451 B2
(45) Date of Patent: Aug. 25, 2015

(54) SYSTEM AND METHOD FOR CONTROLLING STITCHING USING A MOVABLE SENSOR

(75) Inventors: Gary J. Konzak, Salem, UT (US); Richard K. Eich, Layton, UT (US); Bryan K. Ruggles, Riverton, UT (US)

(73) Assignee: Handi Quilter, Inc., North Salt Lake, UT (US)

( * ) Notice: Subject to any disclaimer, the term of this patent is extended or adjusted under 35 U.S.C. 154(b) by 903 days.

(21) Appl. No.: 13/345,296

(22) Filed: Jan. 6, 2012

(65) Prior Publication Data

US 2012/0312213 A1 Dec. 13, 2012

Related U.S. Application Data

(60) Provisional application No. 61/496,316, filed on Jun. 13, 2011.

(51) Int. Cl.
*D05B 1/00* (2006.01)
*D05B 19/12* (2006.01)
*D05B 21/00* (2006.01)

(52) U.S. Cl.
CPC ..... *D05B 19/12* (2013.01); *D05B 21/00* (2013.01)

(58) Field of Classification Search
CPC ..... D05B 59/02; D05B 35/102; D05B 51/00; D05B 21/00; D05B 39/00; G05B 2219/2626
USPC ..... 112/475.02, 475.04, 475.05, 273, 278, 112/314, 102.5, 470.03, 470.06; 700/136, 700/137
See application file for complete search history.

(56) References Cited

U.S. PATENT DOCUMENTS

| | | | |
|---|---|---|---|
| 3,967,566 | A | 7/1976 | Spiegel et al. |
| 4,109,596 | A | 8/1978 | Blessing |
| 4,192,241 | A | 3/1980 | Reed et al. |
| 4,539,925 | A | 9/1985 | Shim |
| 4,658,741 | A | 4/1987 | Jehle et al. |
| 4,706,584 | A | 11/1987 | Senda et al. |

(Continued)

FOREIGN PATENT DOCUMENTS

| | | |
|---|---|---|
| DE | 3525028 | 1/1987 |
| JP | 2002-292175 | 10/2002 |
| WO | WO 2004/072349 | 8/2004 |

OTHER PUBLICATIONS

Welcome to the Quilter's Cruise Control; www.quilterscruisecontrol.com; p. 1-2; Jan. 21, 2005; LiTen Up, Inc.

(Continued)

*Primary Examiner* — Tejash Patel
(74) *Attorney, Agent, or Firm* — Madison IP, P.C.

(57) ABSTRACT

A device controls the speed of needle movement in a sewing machine and thus the stitch length based upon the movement of a motion detection device relative to a reference surface. The formation of stitches by the sewing machine is controlled by detected changes in position of the detection device relative to the reference surface in connection with a predetermined stitch length setting and starting speed, set on either the detection device, an adapter or as part of the sewing machine control. The detection device may move together with the article being sewn while the sewing machine and reference surface remain stationary, or the detection device may move with the sewing machine while the article that is being sewn and reference surface remain stationary.

21 Claims, 6 Drawing Sheets

(56) References Cited

U.S. PATENT DOCUMENTS

| | | | | |
|---|---|---|---|---|
| 4,742,789 | A | 5/1988 | Pestel et al. | |
| 4,766,828 | A | 8/1988 | Nomura et al. | |
| 4,901,660 | A | 2/1990 | Takeuchi et al. | |
| 4,982,677 | A | 1/1991 | Nomura et al. | |
| 5,097,777 | A | 3/1992 | Porter et al. | |
| 5,215,020 | A * | 6/1993 | Pordzik | 112/470.03 |
| 5,553,562 | A | 9/1996 | Jacobs, Jr. | |
| 5,664,508 | A | 9/1997 | Mulcahey et al. | |
| 5,839,380 | A | 11/1998 | Muto | |
| 5,908,004 | A | 6/1999 | Porter et al. | |
| 6,263,815 | B1 | 7/2001 | Furudate | |
| 6,470,813 | B2 | 10/2002 | Ebata et al. | |
| 6,501,460 | B1 | 12/2002 | Paik et al. | |
| 6,718,893 | B1 | 4/2004 | Kong | |
| 6,871,606 | B2 | 3/2005 | Schweizer | |
| 6,883,446 | B2 | 4/2005 | Koerner | |
| 6,959,657 | B1 | 11/2005 | Duval | |
| 6,994,042 | B2 | 2/2006 | Schweizer | |
| 7,210,417 | B2 | 5/2007 | Koerner | |
| 7,325,502 | B2 * | 2/2008 | Konig et al. | 112/475.02 |
| 7,373,891 | B2 * | 5/2008 | Koerner | 112/475.02 |
| 7,854,207 | B2 * | 12/2010 | Kuki et al. | 112/102.5 |
| 8,301,292 | B2 * | 10/2012 | Tokura | 700/138 |
| 2005/0016428 | A1 | 1/2005 | Koerner | |
| 2005/0045083 | A1 | 3/2005 | Canan | |
| 2005/0145149 | A1 | 7/2005 | Hooke | |
| 2008/0229991 | A1 | 9/2008 | Makino et al. | |

OTHER PUBLICATIONS

Carol A. Thelen, Hand-Guided Quilting Systems: Which Should I Buy?, Quilter's Newsletter Magazine; Apr. 2003, pp. 5-8, No. 351, vol. 34, No. 3, Primedia, Inc.

* cited by examiner

SYSTEM AND METHOD FOR CONTROLLING STITCHING USING A MOVABLE SENSOR

RELATED APPLICATION

This application claims the benefit of U.S. Provisional Patent Application Ser. No. 61/469,316 that was filed on Jun. 13, 2011, for an invention titled METHOD AND DEVICE FOR CONTROLLING STITCHING USING A MOVABLE SENSOR, which is herein incorporated by this reference.

TECHNICAL FIELD

The present invention relates generally to controlling quilting and sewing machines. More specifically, the present invention relates to controlling stitching using a movable sensor.

BACKGROUND

Free motion sewing, also called free motion quilting, is performed by an operator with a sewing machine set up with the material transportation device (e.g., feed dogs) in the lower arm of the sewing machine, disabled or non-existent. This allows sewing in any direction the material may move. Stitch length is then controlled by the operator depressing a standard foot control (such as a treadle starter) and moving the material under the needle at a rate which will create the desired stitch length. By relying only on operator control, the stitch length can be inconsistent and uneven. To regulate stitch length, imaging devices have been used on top of the material to determine the position of two adjacent stitching sites of the sewing needle on the article being sewn.

One known method of stitching control uses an optical device for detecting the motion of the top of the article being sewn (i.e., fabric or other material) relative to the machine and so regulates the stitch length by controlling the needle movement. This method places the detector as close as possible to the needle and may be held on a mechanism that moves up and down relative to the article being sewn. This method experiences several different problems. First, optical device technology as described requires that the object being detected be held at a distance from the sensor that does not vary except within a very specific distance range from the optical sensor for accurate detection. This distance cannot be guaranteed when quilting is performed on a stack of material, often consisting of two or more pieces of material with a thick or fluffy batting between them. The stitches already placed tend to compress the batting around the area where they are placed, making the material stack thinner in those areas. The resistance to compression of the batting will make other areas thicker. The distance may be further increased as the mechanism moves the sensor up and down relative to the material. This difference in thickness can easily exceed the optical focal range of image sensors regardless of optics, causing them to provide unreliable movement data for controlling the movement of the needle. If a means is provided to compress the material stack around the sensor detection area to limit the distance variations, this compression device creates resistance to free movement of the material as it is fed into the needle, also creating the potential for unreliable movement data.

Also, during the portion of the stitching cycle when the needle is inserted into the material for the purpose of making the stitch, the material around the needle will not move laterally at the same rate as the rest of the article. A sensor placed at or near the needle as described will not detect material motion during this time, and therefore will not properly control the needle movement. Since no material motion is detected, the needle can hang in the material and the sewing operation will cease. This creates uneven stitches, defeating the purpose of the device.

Further, color variations in the fabric may fool an optical sensor and create incorrect motion data, and therefore, can cause uneven stitches.

Additionally, optical detection of a material stack being sewn by a sensor located next to the needle and viewing the top of the material as described produces inconsistent movement data and therefore inconsistent stitch lengths.

It would be an advance in the art to provide a device that more reliably detects movement of the material and more reliably controls the stitching during free motion sewing.

SUMMARY OF THE INVENTION

Embodiments of the present disclosure provide an improved method and an improved device for controlling the movement of the needle in a sewing machine to control the stitching. A motion detector device is moved relative to a consistently flat reference surface and the movement of the detector device relative to the reference surface is detected, so that movement of the sewing needle can be controlled depending on that relative movement. A device and a method, according to embodiments of this disclosure, can use a mechanical or optical motion detector that senses movement and an adapter to accomplish controlled stitching speed and stitch count. With no or only minor modification to most sewing machines used for free motion sewing, the adapter can be retrofit to the existing sewing machine to control stitching speed and stitch count.

The method and the device according to embodiments of this disclosure use detection of the motion of the detector (a sensor) relative to a stationary reference surface, rather than detecting the moving surface of the material. When using an immobile sewing machine, the article being sewn is held on top of or together with the detector. Then, by moving the detector and article together, the relative motion of the article to the sewing machine is detected.

Alternatively, by fixing the detector to a mobile sewing machine so that together they move relative to a consistent, immobile reference surface, and where that reference surface is connected to an article holding apparatus (e.g., frame), the relative motion of the sewing machine to the article can be detected. As a result, the deviation of the distance between neighboring stitches and/or the position of individual stitches from a selected or adjustable target distance and/or selected or adjustable target positions can be controlled.

In a preferred embodiment of this disclosure, a battery powered, wireless optical detection device is provided, in which an image section of the reference surface is detected in an area away from the presser foot and which is imaged on an image sensor via an optic. The detection area and/or the image field detected is large enough that individual structural or reflective features of the reference surface can be detected several times within the detection range even at relatively high speeds or accelerations. The optic of the detection device has a sufficiently great depth of field that the position or location and/or movement of the optical detection device relative to the reference surface can be detected reliably. The material from which the reference surface is made is chosen to provide the most reliable and accurate response from the detection device.

The optical detection device operates similar to how a computer mouse controls a cursor on a computer screen. A computer mouse provides a computer with the relative or absolute movement of the mouse over a reference surface. Computer mice provide a simple signed X and Y coordinate distance at a periodic report rate determined by the computer operating system mouse driver software. The coordinate system used by the computer mouse uses all four quadrants of movement, +X and +Y, −X and +Y, −X and −Y and +X and −Y. A computer mouse must be held generally in a single orientation relative to the motion plane. Rotating the mouse 90 degrees creates a visual disconnect between the motion of the mouse and the motion of the cursor on the screen.

The detection device described in this disclosure operates in a similar manner, but the quadrant or sign of the X and Y movement is unimportant and is not communicated to the adapter device. Because the previous report is used for control purposes, only the magnitude of the X and Y movement is communicated. Unlike a computer mouse, the detection device described in this invention can be rotated in any orientation on the motion plane without affecting the desired control function.

One implementation requires the operator to grasp and hold the material or material stack being sewn together with the detection device in a manner that assures the material stack will move with the detection device. The material may be physically held against the top of the detection device by the operator, or may be captured together with the detection device by some mechanical means, such as a hoop as used in the quilting arts, or the like. The detection device may be made with a friction surface against which the material may rest so that the material and detection device can be more reliably moved together. The detection device is free to operate anywhere on the reference surface provided that, for proper operation, it is held a minimum distance away from the presser foot to prevent the material holding effect of the presser foot from effecting the detection of movement.

The detection device may be wired or wireless and may have one or more high-intensity, Light Emitting Diodes (LEDs) directed to illuminate through the material in a constant or pulsed manner to provide a visual indication of the detection device's location under the material being sewn. Two or more distinctly different colors of LED may be used as different colored materials may not allow one color alone to show through the material stack.

The detection device may be fitted with two or more switching circuits such that pressing down in a predetermined manner with a predetermined force activates all switching circuits and starts the sewing process. This function may be used in conjunction with or instead of the treadle starter.

Another embodiment affixes the device, which may be wired or wireless, by some mechanical device to a sewing machine operating on a mobilizing transport base, with the material to be sewn attached to a frame such that the material remains stationary within the frame, and the frame is movable. When using the frame system, the frame is disposed adjacent a fixed reference surface upon which the detection device rests. As the operator moves the machine the detection device detects the sewing machine movement relative to the immobile reference surface and controls the movement of the needle based on the relative movement data.

BRIEF DESCRIPTION OF THE DRAWINGS

Exemplary embodiments will become more fully apparent from the following description and appended claims, taken in conjunction with the accompanying drawings. Understanding that these drawings depict only exemplary embodiments and are, therefore, not to be considered limiting of the invention's scope, the exemplary embodiments will be described with additional specificity and detail through use of the accompanying drawings in which:

DETAILED DESCRIPTION

It will be readily understood that the components of this disclosure, as generally described and illustrated in the Figures herein, could be arranged and designed in a wide variety of different configurations. Thus, the following more detailed description of the embodiments of the system and method of the present disclosure, as represented in FIGS. 1 through 6, is not intended to limit the scope of the invention, as claimed, but is merely representative of presently preferred embodiments. Additionally, elements common between figures may retain the same numerical reference designation.

Figure 1:
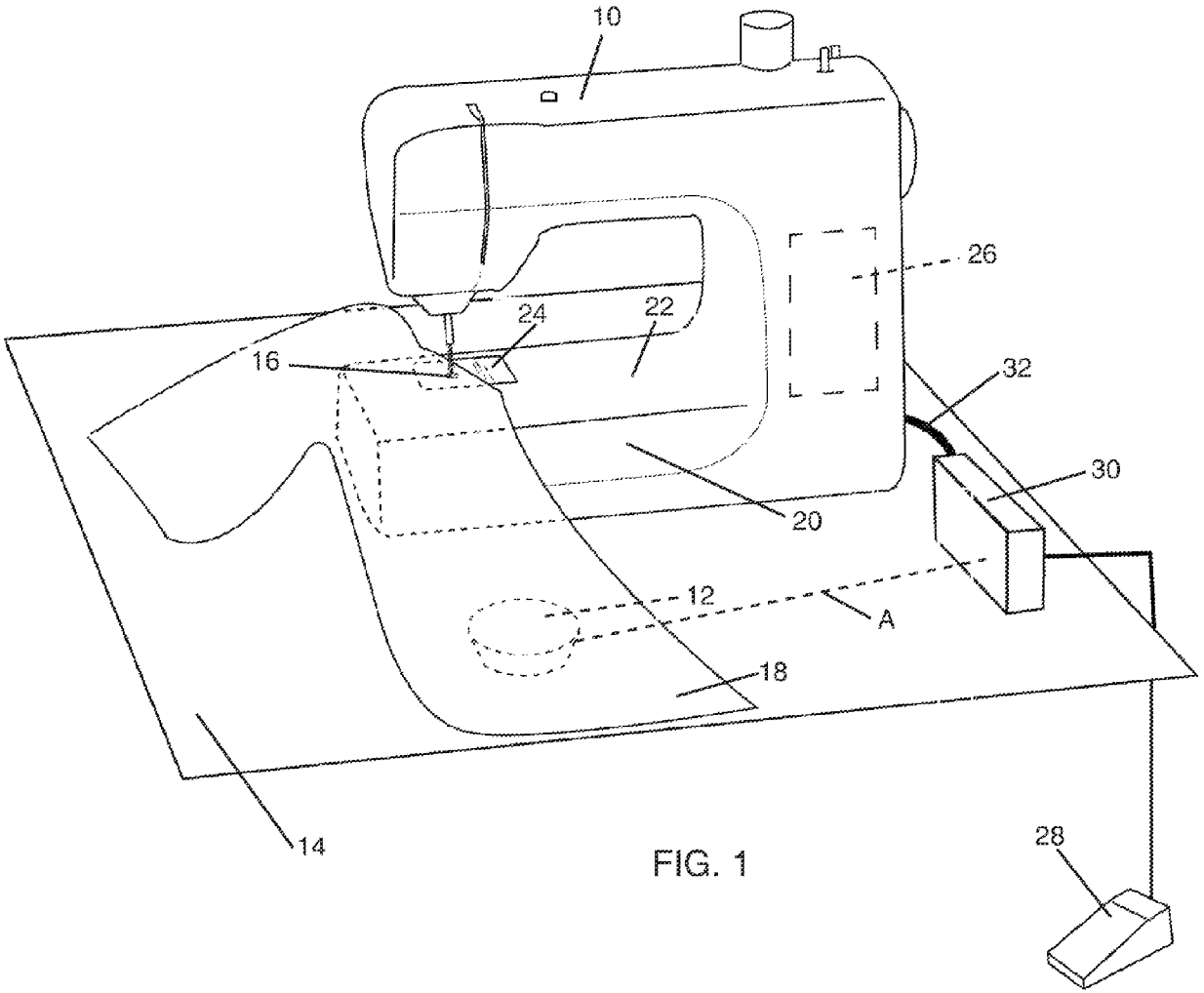
FIG. 1 is a perspective view of a stationary sewing machine with the detection device according to an embodiment of this disclosure.

FIG. 1 shows a perspective view of one preferred embodiment using a sewing machine 10 with a movable detection device 12 for controlling and/or regulating the movement of the sewing needle. Stitching is controlled by detecting relative movement of the movable detection device 12 placed against a stationary reference surface 14 and communicating relative movement information to the sewing machine 10 which interprets that information and stitches according to the relative movement between the detection device 12 and the reference surface 14. With a sewing machine 10 that includes a material transport device (not shown) that provides a hands-free feed during sewing or quilting, the material transport device can be disengaged so that no automatic material transport occurs. Alternately, a sewing machine 10 that does not have any such automatic material transport may be used. A presser foot 16 temporarily holds the material 18 in place during the formation of the stitch. It should be understood that the sewing machine 10 may be a type of machine used to sew quilts and known as a quilting machine.

Further, the sewing machine 10 may be situated on or have connected thereto the reference surface 14 which wraps around the lower arm 20 of the sewing machine 10. The lower arm 20 usually has an upper surface 22 that lies in the same plane as a needle plate 24. The reference surface can lie in the same plane as the upper surface 22 and/or the needle plate 24, ir it can lie in a generally parallel plane.

Sewing machines typically have a machine control 26 that is provided for controlling the operation, including stitch speed and stitch count, of the sewing machine 10. On/off operation of the sewing machine 10 is normally based on the actuation of a treadle starter 28 that communicates with the machine control 26. Actuation and deactivation of the treadle starter 28 causes the stitching to start and stop. Stitch speed may be a function of the degree of depression on the treadle starter 28 or an operator-selection speed control knob (not shown). Stitch count is normally a function of how fast the material 18 is fed past the needle at a given stitch speed.

To regulate stitch speed and stitch count to compensate for the operator movement of the material 18 so that the stitching is even, the detection device 12 uses a sensor or sensing mechanism (not shown in FIG. 1) to communicate by wire, or wirelessly (e.g., by WiFi), as shown by the dashed line A with an adapter 30 that may be placed between the treadle starter 28 and the treadle starter connection 32 either internal or external to the sewing machine 10. Although FIG. 1 shows the detection device 12/adapter 30 assembly as a retrofit connection to the sewing machine 10, a person of skill in the art will understand that the adapter 30 functionality may also be integrated into the machine control 26 internal of the sewing machine 10. The connection via communication link A may serve as a unilateral or bilateral signal transfer between the detection device 12 and the adapter 30, as well as, if necessary, to supply energy to the detection device 12. The effective connection can comprise electric guides and/or optical transmitters and receivers and/or radio connection (e.g., based on Bluetooth technology).

The material 18 to be sewn is placed over and held to or otherwise captured together with the detection device 12 such that the material 18 is moved in synchronized fashion with the detection device 12. The adapter 30 may use the treadle starter 28, or alternately, a signal from the detection device 12 or the sewing machine 10 may be used to start the operation of the sewing machine 10. The adapter 30 receives relative motion data from the detection device 12 via the communication link A.

During operation, the detection device 12 supplies the adapter 30 with new relative motion data at report-rate intervals at a set rate or at a rate determined by the speed of movement of the detection device 12. The adapter 30 manipulates the data received as necessary to send out the appropriate signal (analog or digital) (i.e., a sewing motion signal) to control the needle movement, through the treadle starter connection 32, based upon a desired stitch length and a minimum starting speed settings. As relative motion data is received in the detection device 12, it generates a report and sends this report to the adapter 30, which manipulates the data in the report to create an appropriate sewing motion signal which is provided to the machine control 26. The machine control 26 then delivers corresponding signals to the sewing machine 10 The report generated by the detection device 12 becomes the next previous report when the next relative motion data is received in the detection device 12. This next relative motion data and the information from the next previous report are manipulated by the detection device 12 to create a new report to the adapter 30 which creates a new sewing motion signal for delivery to the machine control 26 and the sewing machine 10 so that the stitch per inch (i.e., stitch count) and stitch speed can be adjusted to maintain the desired stitch length. A description of the flow of information and the function of the adapter 30 is described herein below in describing FIG. 6.

Although throughout this disclosure the detection device 12 and the adapter 30 are described as separate components of a system to regulate stitching, it should be understood that they could be combined into a single device that communicates with the sewing machine 10 to regulate stitching. A person of ordinary skill in the art would know how to combine the detection device 12 and the adapter 30 into just such single device with the functionality of both the detection device 12 and the adapter 30.

It typically is not necessary for the sewing machine control 26 to know whether the treadle starter 28 or the adapter 30 is providing the signal to move the needle, as the adapter 30 may be designed to provide a signal equivalent to a treadle starter 28. For this purpose, the detection device 12 preferably comprises a camera and/or an image sensor. However, other motion sensing techniques may be used, such as strain gauge friction sensors, an opto-interrupter with encoded disk that moves with a ball similar to a ball-type computer mouse, a microwave radar motion detector, and any other motion detection device presently known or to be developed that can sense relative movement between the device and a stationary surface.

Sewing machines 10 that do not have the adapter 30 functionality integrated into the machine control 26 typically require a method to specify and adjust both the desired stitches-per-inch and a minimum sewing speed, also known as "cruise speed," when the sewing machine 10 is started. This may be accomplished by mechanical inputs, e.g., potentiometers with knobs placed on the adapter 30 or with a display such as an LCD graphic or numeric and input device, capacitive touch dials (as on the iPod), or capacitive or resistive controls. Alternately, these controls may be placed on the detection device 12 and the values for these parameters communicated to the adapter through the communication link A. A person of ordinary skill in the art would understand how to implement these types of user interfaces.

The image sensor 34 (shown in FIGS. 2 and 3) captures, in rapid intervals (e.g., with a frame repetition frequency of as much as 11750 Hz or more), a two-dimensional image of the sections of the reference surface 14 located in the detection area of the sensor 34. A high resolution laser mouse type sensor 34 works best, but other sensors 34 are suitable. As the image sensor 34 is moved relative to the reference surface 14 the image processing electronics integrated in the image sensor 34 or subsequent thereto can determine information, e.g., by the change of positions of structural or reflective features of the detected image section, and/or the extent, and/or the speed, and/or the acceleration of the displacement, and/or the change in position (or equivalent or similar values) of the detection device 12 and therefore the article being sewn 18 that is held or attached to it.

The detection range of the image sensor 34 can include the entire reference surface 14 area around the needle made available by the reference surface 14 and the lower arm 20, excluding the area within approximately 20 mm radius around the presser foot 16. Ideally, the detection range is far enough away from the presser foot 16 to prevent disruption in the movement of the detection device 12 during stitch formation.

Figure 2:
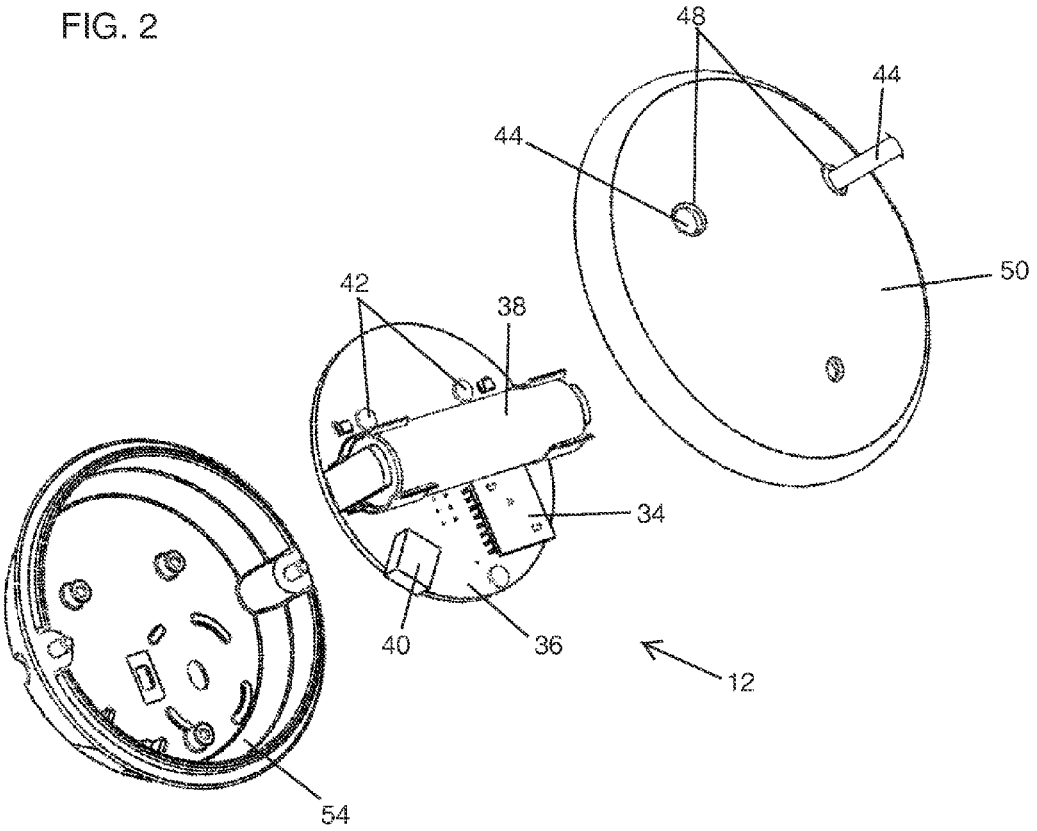
FIG. 2 is an exploded perspective assembly view of an exemplary detection device as viewed from the image sensor top side.

Included on the circuit board 36 for the detection device 12 are accommodations for a rechargeable or non-rechargeable battery 38 and a connection 40 for supplying power for recharging. This connection 40 may also provide a signal path for data exchange as an alternate to wireless communications. Two or more high intensity Light Emitting Diodes (LEDs) 42 may be flashed to indicate the position of the detection device 12 when it is covered by the material 18. These LEDs 42 can be different colors so that if one color does not readily shine through the material 18, then it is likely that the other color will more readily shine through. A light conductor 44 (such as a light pipe, lens or the like) combines and transfers the light from the Light Emitting Diodes 42 through a conduit 46 to an opening 48 (or openings 48) in the top cover 50. In FIG. 2, the light conductor 44 is a light pipe and, for clarity, one light pipe light conductor 44 is shown extending from one of the openings 48, while the other light pipe light conductor 44 is positioned within the conduit 46 (shown best in FIG. 3) and flush with or slightly recessed from the surface of the top cover 50.

When the detection device is assembled, the conduit 46 rests on or near to the LED 42 so that, together with the light pipe light conductor 44, light dispersal is minimized and the light from the LED 42 is directed to emit from the opening 48. FIG. 2 shows two LEDs 42, but it should be understood that it is contemplated that more or less LEDs 42 may be used. For example, there may be no LEDs 42 or just one LED 42 to be used as a detection device 12 locator. Also, more than two LEDs 42 may be used as locators in a single opening (44 and/or 48). Additionally, the LEDs 42 may have other functionality to convey information other than as a detection device 12 locator, such as battery charge indicator or the like.

It may be advantageous, depending upon the type of material 18 being sewn to have a friction surface on the top cover 50 so that material 18 will hold to the detection device without sliding from or sticking to the top cover 50. The friction surface can be the physical texture of the top cover 50 or can be something added to the top cover 50 such as a non-permanent adhesive or the like.

Figure 3:
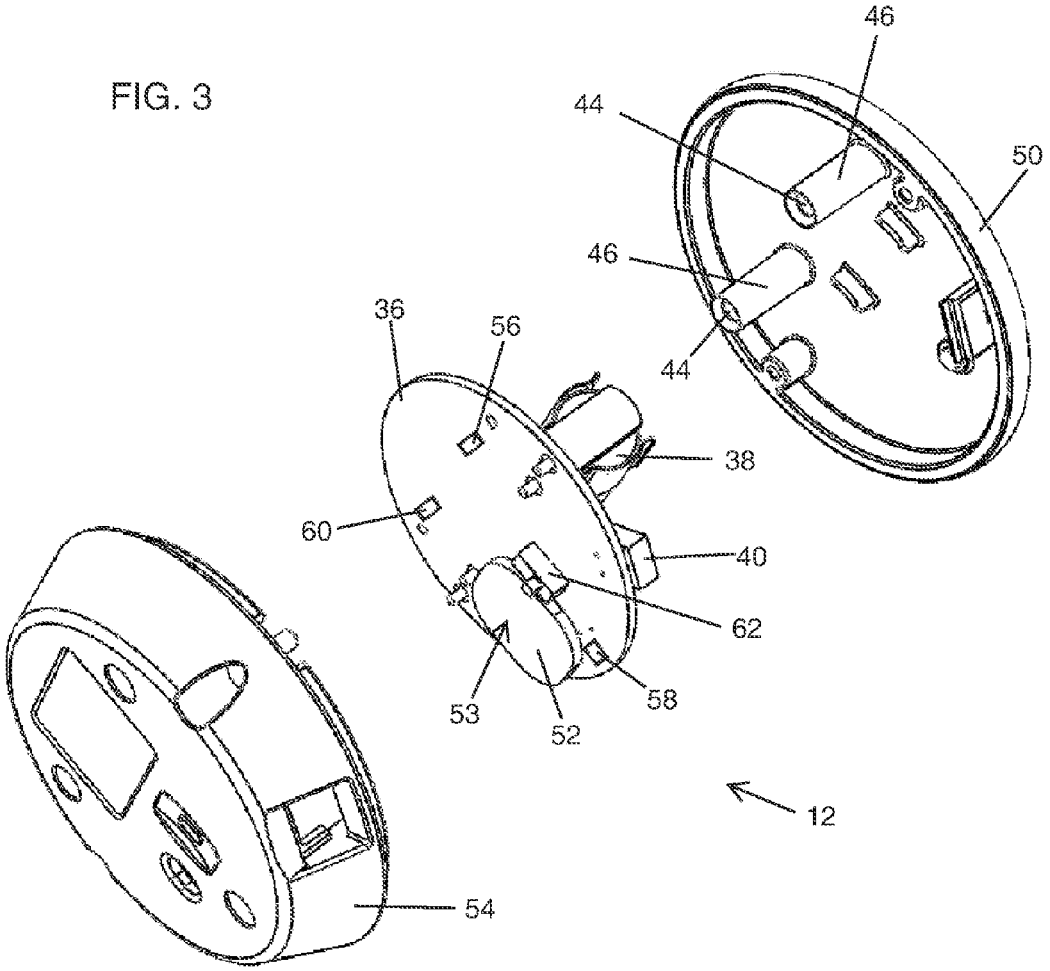
FIG. 3 is an exploded perspective assembly view of the exemplary detection device of FIG. 2 as viewed from the opposite image sensor bottom side.

As best shown in FIG. 3, the optic portion 52 of an image sensor assembly 53 (which includes the sensor 34, not shown in FIG. 3) mounts on the bottom of the circuit board 36 which attaches to the base 54 in a manner that captures the optics 52. Three momentary switches 56, 58, 60 may be used to provide a method to signal the start of sewing machine 10 needle movement and on/off control (much like the treadle starter 28). These momentary switches 56, 58, 60 are actuated by a threshold force being applied to the detection device 12 against the reference surface 14. The threshold force required to actuate the momentary switches 56, 58, 60 may be adjustable and is greater than what would be applied by the mere weight of a stack of material 18 to be sewn, but less than a force that would tire the operator while sewing.

A RF switch 62 may also be used to allow for selection of different radio frequency channels to permit multiple detection devices 12 to operate with different sewing machines 10 that are within the same radio reception range. In an area where more than a single sewing machine 10 is being used, this prevents confusion between sewing machines 10 as each detection device 12 can be associated with only the adapter 30 for a particular sewing machine 10. In this manner, the detection device 12 for a nearby sewing machine 10 will not erroneously send signals to the adapter 30 for a different sewing machine 10. This RF switch 62 capability can be particularly useful in a classroom where quilting is being taught or in a facility that uses multiple sewing machines 10 in close proximity to each other. Alternately the detection device may use a radio communications protocol that automatically detects and changes to a radio frequency channel so that there are no communication conflicts between multiple regulated sewing systems in close proximity to each other.

Figure 4:
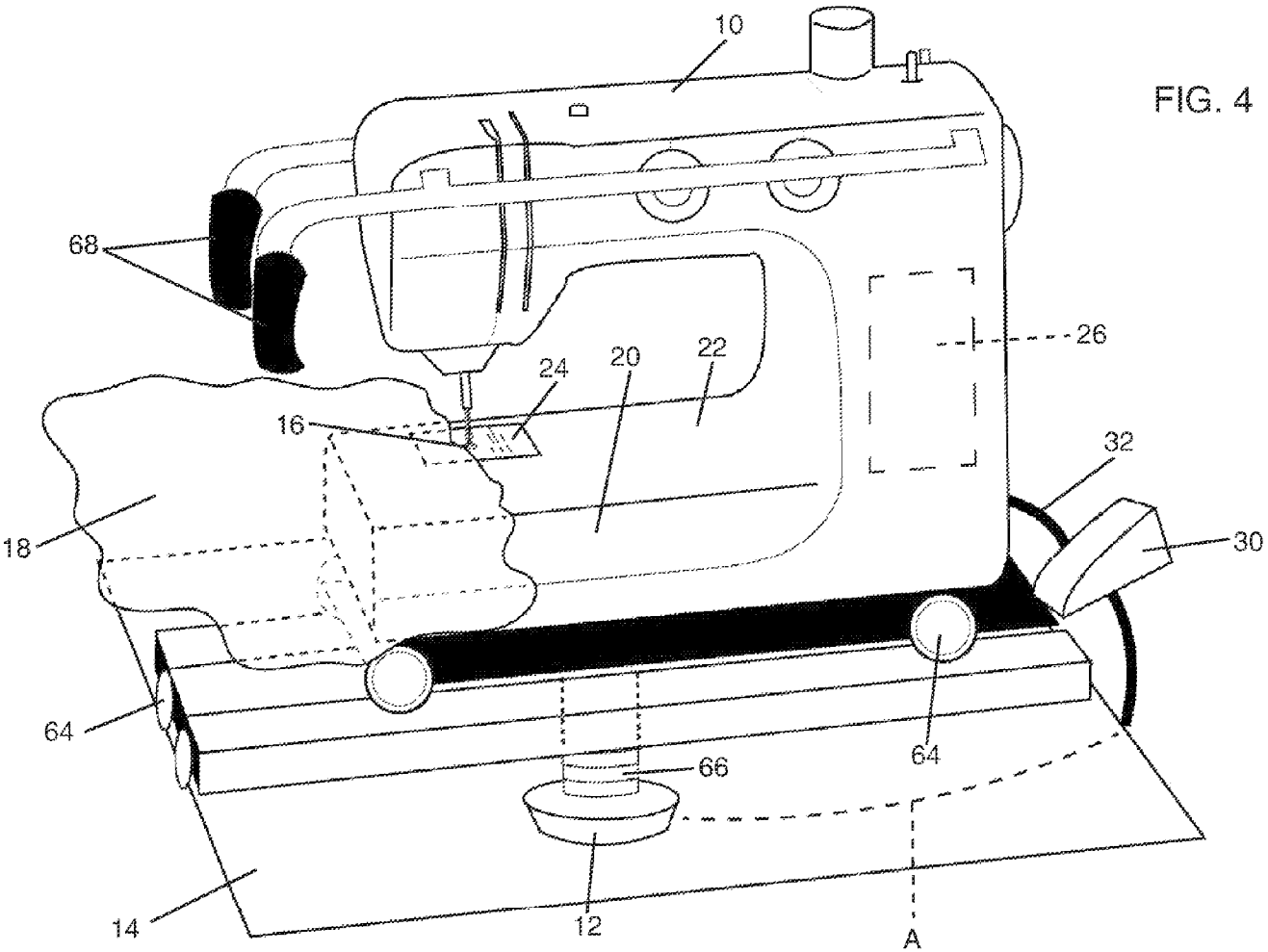
FIG. 4 is a perspective view of a mobile sewing machine with the detection device according to an alternative embodiment.

FIG. 4 shows another preferred embodiment for a sewing machine 10 with a movable detection device 12 to control and/or regulate the movement of the needle depending on the movement of the detection device 12 which is placed against a stationary reference surface 14. Relative movements between the detection device 12 and the stationary reference surface 14 are detected and used to control and regulate stitching in much the same way as has been described previously herein. A person of ordinary skill in the art would understand how to modify the component parts from what has already been described to operate the embodiment of FIG. 4. In this alternative embodiment, the sewing machine 10 is mobile, resting on a transport base 64 that allows the sewing machine 10 to be moved in two directions, in and out and right and left. The movement of the sewing machine 10 accommodates free stitching.

A frame system (not shown, though well known in the sewing art) secures the material 18 to be sewn in a fixed position. Hence, the sewing machine 10 moves while the material 18 does not. With the embodiment illustrated in FIG. 1, the sewing machine 10 is stationary, while the material 18 moves. Like with the previously described embodiment where the detection device 12 moves with the moving component (i.e., material 18), the detection device 12 is attached to the sewing machine 10 and/or the transport base 64 so that it moves with the sewing machine 10 (i.e., the moving component). The detection device 12 can be secured to the sewing machine 10 and/or the transport base 64 in any suitable manner, including with a detector connection mechanism 66 that assures constant contact with the reference surface 14 while the sewing machine 10 is moved relative to the stationary material 18. For convenience, a handle mechanism 68 may be employed to allow easy control of the motion of the sewing machine 10 on the transport base 64. As the sewing machine 10 is physically moved by the operator or moved by automated means around the framed area of the material 18, the detection device 12 detects the movement relative to the reference surface 14 and provides relative motion data via communication link A that allows the adapter 30 to send signals to the machine control 26 to control the sewing machine 10 needle movement.

Figure 5:
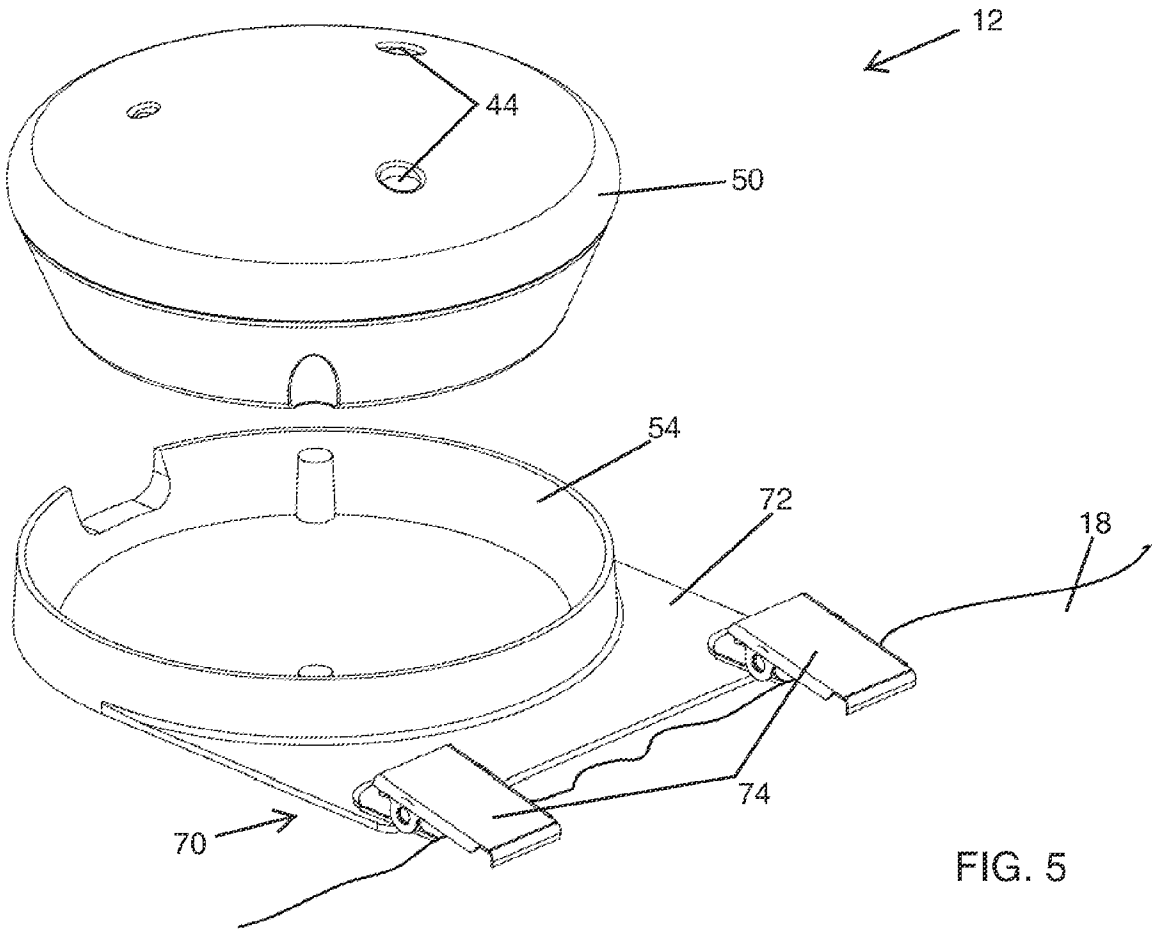
FIG. 5 is a perspective exploded view of a detection device showing an alternative connection to the material of an article suitable for use with small articles.

FIG. 5 shows an alternative way to connect the movable detection device 12 to the material 18. This method for connecting the detection device 12 to the material 18 is particularly useful when the material to be sewn 18 is small and it would be difficult to capture the detection device 12 under the material 18 and still be able to sew the material 18. FIG. 5 shows that the detection device 12 can be physically connected to the material 18 by any suitable means, including external means 70, so long as the movement of the material 18 also moves the detection device 12 or the movement of the detection device 12 also moves the material 18. One form of external means 70 is shown and comprises an extension plate 72 secured to the detection device 12 and a pair of clips 74 that can grasp the material 18. The external means 70 can be a non-permanent attachment that can be removed from the detection device 12 when external connection is not needed.

Figure 6:
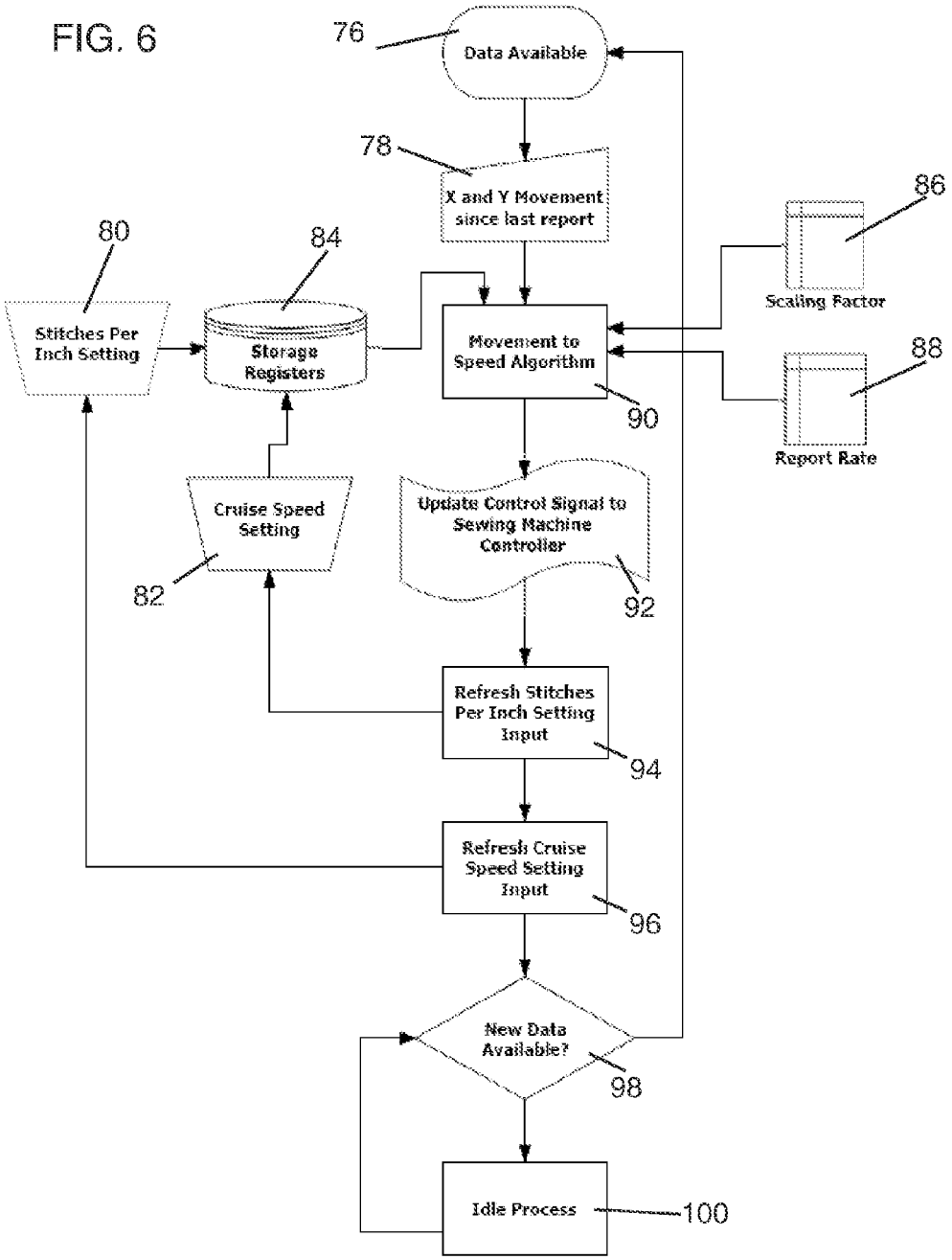
FIG. 6 is a flow chart schematic of the process used to translate the movement information into signals used by the machine control to set the speed of needle motion.

FIG. 6 is a flow chart that demonstrates the process used by the adapter 30 to convert relative motion to control signals used by the machine control 26 to set the needle movement. If the treadle starter 28 or some other indication is given to the adapter 30 that sewing is to commence, and when the detection device 12 provides a relative movement report to the adapter 30 the report is processed using an algorithm. This algorithm uses the report together with the stitches per inch setting, the minimum or cruise speed, the report rate and an internal scaling factor to create a speed value. The adapter 30 then converts the speed value into the analog or digital form required by the machine control to move the sewing machine at the calculated speed. The adapter 30 then updates the stitches per inch and cruise settings in case the user has changed them since the previous operation was performed. When a new report from the detection device 12 is received the process is repeated. Because the appropriate speed is determined by successive reports, only the magnitude of X and Y movement since the next previous report, without orientation, needs to be detected.

Data available oval 76 signifies the information available from the next previous report and the start of the flow chart of FIG. 6. Box 78 indicates that the detection device 12 detects and then sends the adapter 30 relative motion data (i.e., the X and Y movement since the last report). The adapter 30 also receives information from various other sources. For example, block 80 supplies the preselected stitches per inch setting and block 82 supplies the preselected or adjusted cruise speed setting from the user interface described previously and are preserved in the storage registers 84. The storage registers 84 supply the stitch per inch and cruise speed information to the adapter's 30 speed algorithm. Also, supplied to the adapter's 30 speed algorithm is a scaling factor 86 (scaling information similar to what a computer uses to scale mouse movement to movement of a cursor on a screen) that scales movement of the detection device 12 to movement of the sewing needle. A report rate 88 setting predetermined between the detection device 12 and the adapter 30 also scales the movement information based on the frequency with which reports are received.

With all of these inputs, the adapter 30 calculates the movement to speed algorithm at calculation rectangle 90 and updates the control signal sent to the sewing machine control 26, at control signal scroll 92, to update the sewing machine 10 speed to maintain the desired stitch length. Input box 94 shows that the adapter 30 refreshes the stitches per inch setting from the user interface. Input box 96 shows that the adapter 30 refreshes the cruise speed setting from the user interface. The adapter 30 then updates the stitch per inch setting (at block 80) and updates the cruise speed setting at block 82 then preserves them in storage registers 84.

The communication link A is examined at diamond 98 to determine if a new data report is available. If new data is available, that new data becomes the data available at data available oval 76. If no new data is available, an idle process (at block 100) monitors communications link A to determine when new data becomes available.

This process repeats as data reports become available so long as the sewing machine remains on, thereby continuously updating the stitches per inch and cruise speed and adjusting the control signal 92 to maintain stitch length and evenness.

While specific embodiments and applications of the present invention have been illustrated and described, it is to be understood that the invention is not limited to the precise configuration and components disclosed herein. Various modifications, changes, and variations which will be apparent to those skilled in the art may be made in the arrangement, operation, and details of the methods and systems of the present invention disclosed herein without departing from the spirit and scope of the invention.

What is claimed is:

1. A system for regulating the stitching speed as material is sewn by a sewing machine having a machine control, comprising:

a detection device that detects movement of the detection device relative to a stationary reference surface; and an adapter in communication with the detection device, the adapter receiving relative motion data from the detection device and generating a report and a sewing motion signal that is sent to the machine control that can reset stitch per inch and speed settings for the sewing machine.

2. A system according to claim 1, wherein the detection device detects movement of the detection device relative to a stationary reference surface at report-rate intervals and the report generated by the adapter becomes a next previous report when the next subsequent report is generated.

3. A system according to claim 2, wherein the sewing motion signal depends upon the relative motion data and the information from the next previous report.

4. A system according to claim 1, wherein the movement of the detection device and the material being sewn is synchronized, the sewing machine is stationary.

5. A system according to claim 1, wherein the movement of the detection device and the sewing machine is synchronized, the material being sewn is stationary.

6. A system according to claim 5, wherein the sewing machine is mounted on a transport base and the detection device is mounted on the transport base so that the detection device detects movement of the sewing machine relative to the reference surface.

7. A system according to claim 1, wherein the generated sewing motion signals are adapted to the unique control requirements of the sewing machine.

8. A system according to claim 7, wherein the machine control is external of the sewing machine and the adapter communicates with the external machine control to deliver the sewing motion signals to the machine control.

9. A system according to claim 1, wherein the detection device further comprises a sensor that detects movement of the detection device relative to a stationary reference surface.

10. A system according to claim 9, wherein the sensor detects movement of the detection device relative to a stationary reference surface by imaging means.

11. A system according to claim 9, wherein the sensor detects movement of the detection device relative to a stationary reference surface by mechanical means.

12. A system according to claim 1, wherein the detection device further comprises at least one indicator light for directing light through the material so that the location of the detection device is indicated.

13. A system according to claim 10, the at least one indicator light is a Light Emitting Diode.

14. A system according to claim 1, wherein the detection device further comprises at least two indicator lights for directing light through the material so that the location of the detection device is indicated, and at least two of the at least two indicator lights emit different colored light.

15. A system according to claim 1, wherein the detection device further comprises a friction surface.

16. A system according to claim 1, wherein the detection device further comprises a switching mechanism that actuates the operation of the sewing machine by pressing the detection device against the reference surface with a threshold force.

17. A system according to claim 1, wherein the adapter is retro fit to the sewing machine.

18. A system according to claim 1, wherein the detection device has a connector for grasping the material so that the detection device and material can move in synchronization.

19. A method for regulating the stitching speed as material is sewn by a sewing machine, comprising the steps of:

providing a detection device that detects movement of the detection device relative to a stationary reference surface;

providing an adapter in communication with the detection device, the adapter for receiving relative motion data from the detection device;

detecting movement of the detection device relative to the stationary reference surface;

sending the relative motion data to the adapter;

generating a report;

generating a sewing motion signal;

sending the sewing motion signal to the sewing machine; and adjusting the stitch per inch and speed settings for the sewing machine.

20. A method according to claim 19, wherein the step of detecting movement of the detection device relative to the stationary reference surface is performed at report-rate intervals and the report generated by the adapter becomes a next previous report when the next subsequent report is generated.

21. A method according to claim 20, wherein the sewing motion signal depends upon the relative motion data and the information from the next previous report.

* * * * *